United States Patent [19]

Franklin et al.

[11] 4,313,990

[45] Feb. 2, 1982

[54] PILE WEATHERSTRIP

[75] Inventors: Timothy W. Franklin, Luton, England; Paul G. Declercq, Kortriji, Belgium

[73] Assignee: Schlegel (UK) Limited, Leeds, England

[21] Appl. No.: 193,121

[22] Filed: Oct. 2, 1980

[30] Foreign Application Priority Data

Oct. 8, 1979 [GB] United Kingdom ..... 34795/79
May 30, 1980 [GB] United Kingdom ..... 17736/80

[51] Int. Cl.[3] ..... D04H 11/00; E06B 7/22

[52] U.S. Cl. ..... 428/85; 49/489; 156/72; 428/92

[58] Field of Search ..... 425/85, 92; 156/72; 49/489; 428/85, 92

[56] References Cited

U.S. PATENT DOCUMENTS 3,175,256 3/1965 Horton ..... 49/489
3,404,487 10/1968 Johnson ..... 156/72

*Primary Examiner*—Marion McCamish
*Attorney, Agent, or Firm*—Cumpston & Shaw

[57] ABSTRACT

Pile weatherstripping for forming a draught excluder around doors and windows, wherein pile material (3) projects from the face of a backing strip (1) which is preferably flexible and at least three barrier fins 5 are associated with the pile material (3). Preferably, the barrier fins 5 are located within the pile material and it is preferred that two V-shaped fins are provided, one within the other.

6 Claims, 1 Drawing Figure

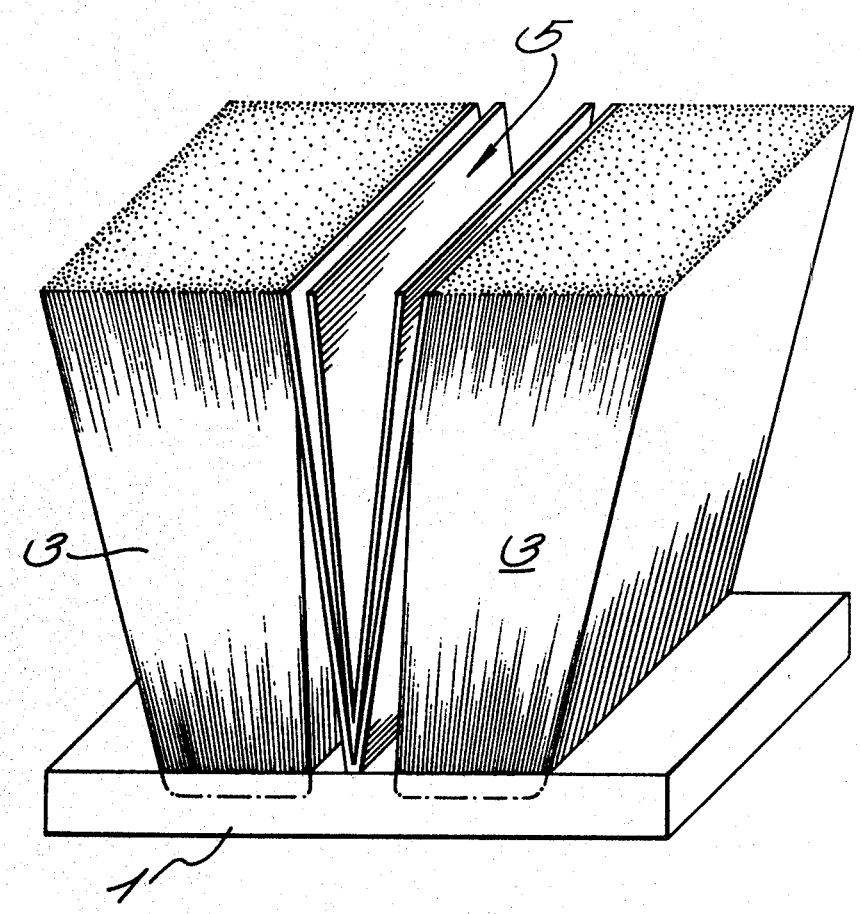
5
3
3
1

PILE WEATHERSTRIP

This invention relates to pile weatherstrip for forming a draught excluder around doors and windows. The invention is an improvement over that the subject of our U.K. Pat. No. 1,000,753.

Pile weatherstripping incorporating an impermeable barrier film within the pile material has excellent weathering properties, but the presence of the barrier film can cause problems, both with sliding windows, whether of the sash type or of the horizontal sliding type, and with the hinged casement and horizontal pivot windows. For example, the presence of the film increases the breakaway force needed to overcome the friction between window sash and weatherstrip when a window is to be opened. Furthermore, if the window or door is kept closed for a long time a single barrier film tends to take a set, i.e. it remains in its partially collapsed state, even after the door or window has been opened, thus gradually reducing the weatherstrip's performance. Also, in certain situations, the film tends to collapse or fold over when the weatherstrip is inserted into a groove in a door or window, probably because of reverse bending of the weatherstrip during the insertion process. A further problem with known pile weatherstrip incorporating a barrier fin is that it is rather stiff and resists compression when a door or window is to be shut. This means that to shut the window and compress the strip, considerable force must be applied to the door or window.

We have now developed an improved pile weatherstrip incorporating a barrier which reduces or overcomes at least some of the above problems, the barrier being secured to the backing strip or pile material in known manner.

According to the present invention we provide pile weatherstripping comprising a backing strip having pile material projecting from one of its surfaces, there being at least three fins associated with the pile material and extending away from the backing strip in the same direction as the pile material. Preferably the fins are located within the pile material.

Preferably, the backing strip is flexible.

Preferably, the fins are heat sealed to the backing strip.

Preferably, the fins are formed of a very thin, polymeric film material.

Preferably, four fins are provided by two inverted V-shaped films of material secured to the backing strip at the apex of the V's.

Preferably, one fin is located within the other.

The polymeric material may be polythene or a polyester of very thin gauge, or polypropylene.

One embodiment of the present invention is now described by way of example with reference to the accompanying drawing, which is a perspective view of a short length of weatherstrip.

Referring to the FIGURE, the weatherstrip has a traditional flexible backing strip 1 which may be formed of a woven plastics material and from one face of which the traditional pile material 3 of the required height and density upstands. The pile material can be connected to the backing strip in any known way, e.g. by a knitting process. Within the pile material a plurality of fins 5 is provided. These fins may be provided by two V-shaped strips as illustrated, or by a plurality of individual strips of plastics film material. The fins 5 may be heat sealed to the backing strip 1 or connected by means of adhesive, or in any other known manner. Furthermore, instead of being connected to the backing strip, they may be connected just to the pile material 3.

In these constructions, the film material of the fins is very thin and easily collapsible, thus reducing compression forces which have to be overcome when a hinged door or window fitted with the weatherstrip is shut. Also, the nature of the film material is such that frictional forces between the frame of a window/door or window/door to which the weatherstrip is fitted and the weatherstrip are kept to a minimum. A very suitable film material is polypropylene.

Hence, it is not too difficult to open or close a door fitted with the weatherstrip, because of minimal "breakaway" forces.

By having a plurality of fins, which can be very thin, the fins can readily adjust for sash and frame tolerances in all three dimensions and there is of course a maximum sealing surface area available thus giving a higher probability of fin engagement with misaligned mating surfaces.

While the fins 5 are shown located within the pile material 3, it will be appreciated that at least one fin may be provided along one or along each side edge of the upstanding pile.

We claim:

1. Pile weatherstripping comprising a backing strip, pile material projecting from one of the surfaces of said backing strip and including at least two V-shaped fins associated with said pile material, said at least two V-shaped fins extending away from said backing strip in the same direction as said pile material.

2. Weatherstripping according to claim 1 wherein said backing strip is flexible.

3. Weatherstripping according to claim 1 wherein said fins are formed of a very thin, polymeric film material.

4. Weatherstripping according to claim 1 wherein said fins are located within said pile material.

5. Weatherstripping according to claim 1 wherein one fin is located within the other.

6. Weatherstripping according to claim 1 wherein said fins are formed of polythene, polypropylene or a polyester of very thin gauge.

* * * * *